US011298583B2

(12) United States Patent
Hsieh

(10) Patent No.: US 11,298,583 B2
(45) Date of Patent: Apr. 12, 2022

(54) EXERCISE MACHINE FRICTION BRAKE CALIBRATION

(71) Applicant: Paul Hsieh, City of Industry, CA (US)

(72) Inventor: Paul Hsieh, City of Industry, CA (US)

(73) Assignee: Paradigm Health and Wellness, Corona, CA (US)

( * ) Notice: Subject to any disclaimer, the term of this patent is extended or adjusted under 35 U.S.C. 154(b) by 154 days.

(21) Appl. No.: 16/457,735

(22) Filed: Jun. 28, 2019

(65) Prior Publication Data

US 2020/0001129 A1 Jan. 2, 2020

Related U.S. Application Data

(60) Provisional application No. 62/691,368, filed on Jun. 28, 2018.

(51) Int. Cl.
*A63B 22/00* (2006.01)
*A63B 22/06* (2006.01)
(Continued)

(52) U.S. Cl.
CPC ..... *A63B 22/0046* (2013.01); *A63B 21/015* (2013.01); *A63B 21/225* (2013.01);
(Continued)

(58) Field of Classification Search
CPC ..... A63B 21/015; A63B 21/018; A63B 21/02; A63B 21/021; A63B 21/022; A63B 21/023; A63B 21/025; A63B 21/026; A63B 21/027; A63B 21/028; A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/055; A63B 21/0552; A63B 21/0555; A63B 21/0557; A63B 21/225; A63B 21/00058; A63B 21/00189; A63B 21/00069; A63B 21/00072;
(Continued)

(56) References Cited

U.S. PATENT DOCUMENTS 1,825,364 A * 9/1931 Ross ..... F16K 31/60 74/526
2,829,538 A * 4/1958 Mueller ..... F16K 35/027 74/548

(Continued)

*Primary Examiner* — Megan Anderson
*Assistant Examiner* — Thao N Do
(74) *Attorney, Agent, or Firm* — Kirk A. Buhler; Buhler & Associates Patenting

(57) ABSTRACT

Improvements in a flywheel friction loading measurement system is disclosed. The measurement system includes combining a rotational system that alters friction on a flywheel combined with a variable resistor or potentiometer. The combination proves a measurable system that can determine the loading on a piece of exercise equipment. The potentiometer is calibrated to provide a repeatable and reliable measurement of the loading system that is placed on a flywheel. Detents can be included to provide finite loading positions. A calibration sequence can also be used to communicate the friction to a display and measurement system. The rotational system is with pulling a cable on a rotational axis or with wrapping a cable chain, belt or equivalent on or around a rotational axis.

18 Claims, 5 Drawing Sheets

(51) Int. Cl.
*A63B 21/015* (2006.01)
*A63B 22/04* (2006.01)
*A63B 21/22* (2006.01)
*A63B 22/02* (2006.01)

(52) U.S. Cl.
CPC ..... *A63B 22/02* (2013.01); *A63B 22/04* (2013.01); *A63B 22/0605* (2013.01); *A63B 22/0664* (2013.01); *A63B 2225/09* (2013.01)

(58) Field of Classification Search
CPC . A63B 21/0076; A63B 21/151; A63B 21/152; A63B 21/153; A63B 21/154; A63B 21/155; A63B 21/156; A63B 21/157; A63B 21/012; A63B 21/0125; A63B 21/22; A63B 21/222; A63B 22/0046; A63B 22/02; A63B 22/04; A63B 22/0605; A63B 22/0664; A63B 2225/09; A63B 2225/093; A63B 2220/00605; A63B 2220/805; A63B 2220/36; A63B 2220/16; A63B 2220/40; A63B 2220/34; A63B 2071/025; A63B 2230/06; A63B 21/15
USPC ..... 482/51, 57, 142, 908, 63
See application file for complete search history.

(56) References Cited

U.S. PATENT DOCUMENTS 3,213,842 A * 10/1965 Laney ..... A63B 69/408 124/7
3,601,395 A * 8/1971 Morgan ..... A63B 22/0012 482/62
3,848,467 A * 11/1974 Flavell ..... A63B 21/153 482/4
3,865,383 A * 2/1975 Clay ..... A63B 69/0059 473/213
3,986,409 A * 10/1976 Tripp ..... G05G 1/02 74/548
3,995,853 A * 12/1976 Deluty ..... A63B 21/015 482/116
4,007,927 A * 2/1977 Proctor ..... A63B 21/015 482/63
4,084,675 A * 4/1978 Smith ..... F16D 11/14 192/69.8
4,148,478 A * 4/1979 Moyski ..... A63B 22/0605 482/63
4,184,678 A * 1/1980 Flavell ..... A63B 21/153 482/6
4,235,439 A * 11/1980 De Donno ..... A63B 21/015 188/75
4,453,152 A * 6/1984 Dob ..... D05B 19/006 338/134
4,484,741 A * 11/1984 Bingisser ..... A63B 21/015 482/114
4,512,567 A * 4/1985 Phillips ..... A63F 13/06 463/37
4,529,194 A * 7/1985 Haaheim ..... A63B 21/012 482/70
4,618,139 A * 10/1986 Haaheim ..... A63B 22/203 482/115
4,630,829 A * 12/1986 White ..... A63B 69/36 250/237 R
4,637,605 A * 1/1987 Ritchie ..... A63B 71/0622 463/37
4,711,447 A * 12/1987 Mansfield ..... A63F 9/143 463/37
4,955,599 A * 9/1990 Bersonnet ..... A63B 22/0605 482/63
4,984,986 A * 1/1991 Vohnout ..... A63B 24/00 434/247
5,163,888 A * 11/1992 Stearns ..... A63B 21/015 482/110
5,184,986 A * 2/1993 Wilkinson ..... A63B 23/14 482/118
5,199,931 A * 4/1993 Easley ..... A63B 21/015 482/110
5,232,422 A * 8/1993 Bishop, Jr. ..... A63B 22/0007 482/57
5,240,417 A * 8/1993 Smithson ..... A63B 21/00181 434/61
5,346,451 A * 9/1994 Miller ..... A63B 21/154 482/112
5,507,712 A * 4/1996 Chang ..... A63B 21/0004 482/126
5,538,488 A * 7/1996 Villepigue ..... A63B 21/0004 482/44
5,580,337 A 12/1996 Habing et al.
5,720,698 A * 2/1998 Dalebout ..... A63B 21/015 482/51
5,916,069 A * 6/1999 Wang ..... A63B 21/153 482/72
6,371,891 B1 * 4/2002 Speas ..... A63B 21/157 280/210
7,087,001 B1 * 8/2006 Ihli ..... A63B 21/015 119/795
7,226,393 B2 6/2007 Baker
8,052,581 B1 * 11/2011 Lohr ..... A63B 21/015 482/63
8,585,561 B2 11/2013 Watt et al.
9,839,810 B1 * 12/2017 Tzeng ..... A63B 21/00072
2001/0003110 A1 * 6/2001 Lay ..... A63B 22/0605 482/57
2002/0013197 A1 * 1/2002 Tacx ..... A63B 21/0051 482/61
2004/0176218 A1 * 9/2004 Fan ..... A63B 21/00069 482/57
2005/0003934 A1 * 1/2005 Wu ..... A63B 21/0051 482/64
2005/0124471 A1 * 6/2005 Wilkinson ..... A63B 21/153 482/121
2008/0096725 A1 * 4/2008 Keiser ..... A63B 22/0605 482/8
2010/0009815 A1 * 1/2010 Chen ..... A63B 21/00069 482/63
2011/0082009 A1 * 4/2011 Ranky ..... A63B 24/0062 482/8
2012/0088612 A1 * 4/2012 Johnson ..... A63B 69/3632 473/422
2013/0237387 A1 * 9/2013 Bass ..... A63B 69/16 482/61
2015/0018109 A1 * 1/2015 Goebel ..... A63B 47/002 473/136
2015/0335936 A1 * 11/2015 Shakespeare ..... A63B 21/225 482/58
2015/0367164 A1 * 12/2015 Myre ..... A63B 21/0726 482/107
2016/0263417 A1 * 9/2016 Golesh ..... A63B 21/00069
2018/0015321 A1 * 1/2018 Ho ..... A63B 21/00069
2018/0021617 A1 * 1/2018 Krull ..... A63B 21/153 482/128
2018/0056160 A1 * 3/2018 LoDuca ..... A63B 69/0002
2018/0207468 A1 * 7/2018 Golesh ..... A63B 21/00072
2018/0214731 A1 * 8/2018 Sherin ..... A63B 21/00065
2019/0262687 A1 * 8/2019 LoDuca ..... A63B 69/0075

* cited by examiner

EXERCISE MACHINE FRICTION BRAKE CALIBRATION

CROSS REFERENCE TO RELATED APPLICATIONS

This application claims the benefit of Provisional Application Ser. No. 62/691,368 filed Jun. 28, 2018 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in calibrating a resistance loading system on exercise equipment. More particularly, the present calibration incorporates a potentiometer with a capstan where the wrap of a cable on the capstan is measured as rotation of the potentiometer.

Description of Related Art Including Information Disclosed Under 37 CFR 1.97 and 1.98

One common method of loading or creating resistance on a piece of exercise equipment is with a resistance loading system that retards rotation of a flywheel with a magnetic eddy current resistance system, a strap over a flywheel or with one or more pads against a flywheel. The resistance to rotation of the flywheel is adjusted by pulling on a cable that pulls the strap or puts pressure on the flywheel. While the tension, pull or wrap of the cable on the capstan can be determined with the rotation of the capstan, the position is shown with a pointer. In another embodiment, the mechanism can measure multiple turn of a threaded screw that pushes or pulls on a friction brake. There is no prior mechanism to translate the wrap of the cable on the capstan to an electrical signal that can be communicated to an electronic display or measurement system.

There is a large number of exercise equipment loading systems that instruct the user to make adjustments to the braking system to alter the load to simulate an outdoor workout or to perform heart rate control. The reliance on the operator to make the adjustment is necessary because there is no feedback system to the display that can make reliable and repeatable changes. Caloric consumption can't be accurately determined and is only an estimate based upon the rotational speed of the flywheel.

A number of patents and or publications have been made to address these issues. Exemplary examples of patents and or publication that try to address this/these problem(s) are identified and discussed below.

U.S. Pat. No. 5,580,337 issued on Dec. 3, 1996 to Theodore G. Habing et al., is titled Exercise Machine Adjustment Mechanism. This patent discloses an adjustment mechanism for an exercise machine which enables the relative position between a support for the operator of the machine and an exercise member to be adjusted by the operator while in the exercise position. While the angular position of the adjustment mechanism can be visually determined, the angular position is not electronically determined.

U.S. Pat. No. 7,226,393 issued on Jun. 5, 2007 to William A. Baker is titled Exercise Bicycle. This patent discloses using a threaded rod to push on a brake pad. There is no display on the knob and no measurement mechanism that determines the variable brake pressure.

U.S. Pat. No. 8,585,561 issued on Nov. 19, 2013 to Jonathan B. Watt et al., is titled Exercise Bike. This patent discloses a knob that is turned to increase and decrease resistance to the flywheel turning. While the resistance can be changed by turning the knob there is no mechanism to determine the amount of resistance, and there is a mechanism for repeatability of the knob position to preset the resistance.

What is needed is a measurable feedback system that is being sent electronically back to a console or computer that can repeatedly provide information on the load being applied to a flywheel. The proposed exercise machine friction brake calibration mechanism disclosed in this document provides the solution.

BRIEF SUMMARY OF THE INVENTION

It is an object of the exercise machine resistance brake calibration mechanism to operate with a resistance brake. Resistance brakes are a common type of loading or resistance in exercise equipment. The exercise equipment can be a variety of types including, but not limited to bicycles, spinners, steppers and elliptical machines. The brake can be a flywheel as a prony brake, a brake that pinches a flywheel or pushes a friction pad against the flywheel, fan, water resistance and magnetic eddy current resistance system.

It is an object of the exercise machine resistance brake calibration mechanism to be linked to the rotating capstan. The capstan can wrap around a post or pole, or the capstan can be a cable being pulled on a radius around a central axis. In both cases the tension or displacement of the cable can be determined. The rotation could be a few degrees, to 360 degrees, multi-turn resistor, geared from the post to the resistor or other ratio and turns depending upon the design requirement and function. Measuring the position of the screw allows a new user to immediately determine the loading without turning the pedals on an exercise bike or spinner bike.

It is another object of the exercise machine resistance brake calibration mechanism to be linked to a rotating threaded screw. Turning the threaded screw can turn a multi-turn resistor/potentiometer or can be geared to turn the single turn variable resistor/potentiometer. With a screw type loading system, the amount of contact between the friction pad and the flywheel is nearly impossible to determine until the flywheel is turned.

It is another object of the exercise machine resistance brake calibration mechanism to have detents in rotation. The detents in rotation can be calibrated with the resistance value for repeatability and to provide positive feedback for finite settings of resistance. Calculations for the braking can be performed to convert the resistance, to cable tension/belt tension combined with the diameter of the flywheel, contact surface area and flywheel rate of rotation to calibrate work, horse power, watts or other units.

It is another object of the exercise machine resistance brake calibration mechanism to provide an electronically measurable and repeatable detection of the loading system. The feedback of the resistance value can be measured by a display/measurement system to provide a reliable and repeatable measurement of the loading system. This information can then be sent to a processor for further calculations.

It is still another object of the exercise machine resistance brake calibration mechanism to allow for an electronic adjustment to a friction brake to load the workout of a user. The feedback of the resistance value is important and has a relationship to the loading or braking system.

It is still another object of the exercise machine resistance brake calibration mechanism to include a calibration sequence that can be determined globally for all similar pieces of exercise equipment or can be calibrated individually for each piece of exercise equipment.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
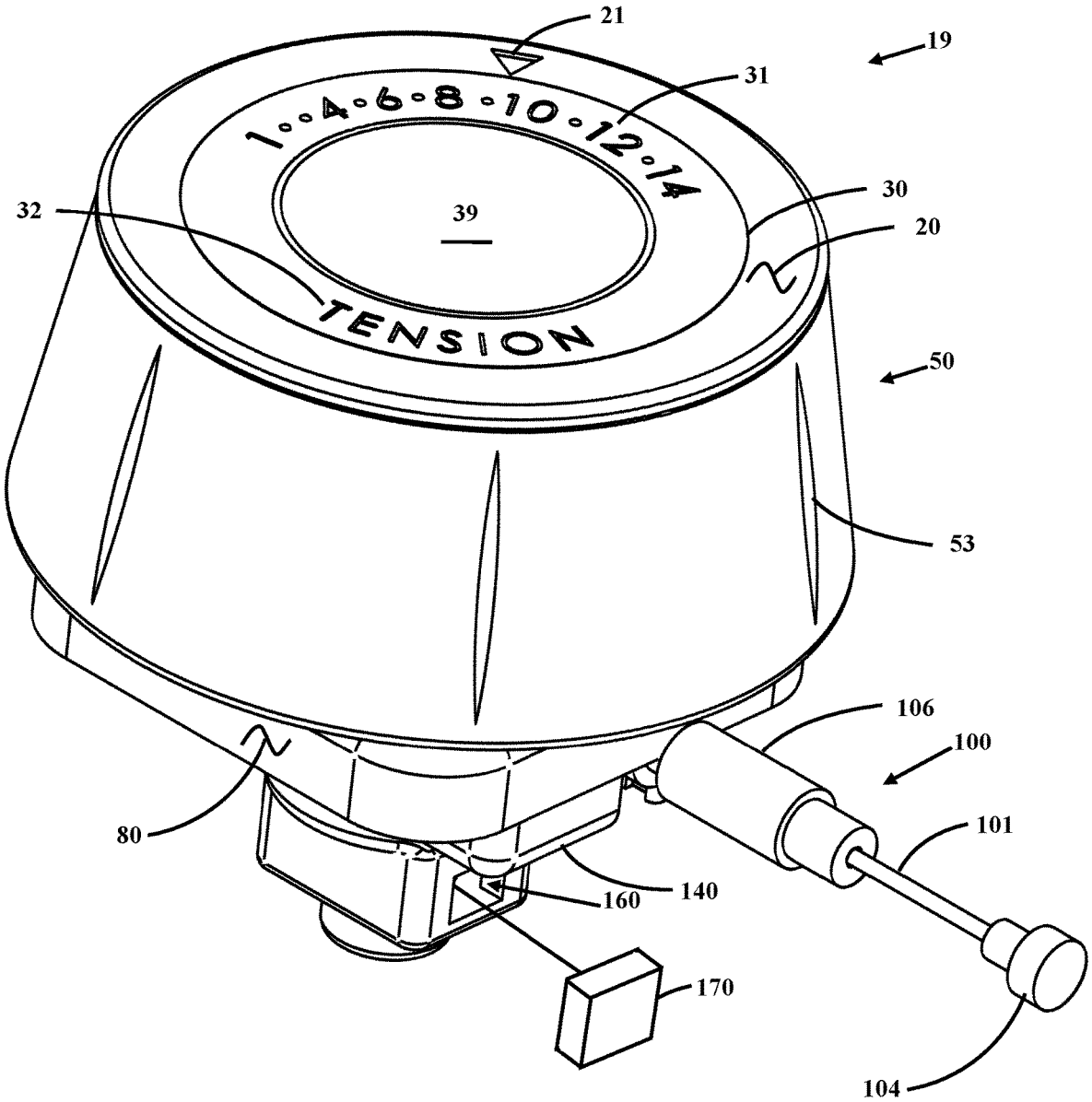
FIG. 1 shows a perspective view of the exercise machine resistance level tracking unit mechanism.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

Item Numbers and Description

| | | | | | |
|---|---|---|---|---|---|
| 19 | mechanism | 20 | outer label | 21 | marker |
| 30 | inner label | 31 | indicia | 32 | markings |
| 39 | cover | 40 | disc cap | 41 | square recess |
| 42 | recess | 50 | knob | 51 | square hole |
| 52 | recess | 53 | rib | 54 | stud |
| 60 | detent wheel | 61 | hole | 62 | detent holes |
| 63 | square hole | 70 | spring | 71 | ball |

-continued

Item Numbers and Description

| | | | | | |
|---|---|---|---|---|---|
| 80 | top housing | 81 | spring clearance hole | 82 | recess sector |
| 83 | central hole | 84 | side wall | 90 | capstan |
| 91 | vertical walls | 92 | spring lock tab | 93 | central opening |
| 94 | circular hole | 95 | circular recess | 100 | cable leader |
| 101 | cable | 102 | pivot end | 103 | recess |
| 104 | end cap | 105 | shoulder | 106 | shank |
| 110 | post | 111 | square head | 112 | shank |
| 113 | flat shoulder | 114 | square drive | 120 | drive stop |
| 121 | arm | 122 | square hole | 130 | wheel |
| 131 | circular body | 132 | sector hole | 133 | tab(s) |
| 140 | bottom housing | 141 | opening | 142 | central portion |
| 143 | fingers | 150 | cap | 151 | cap bottom |
| 152 | flat | 160 | potentiometer | 161 | contacts |

FIG. 1 shows a perspective view of the exercise machine resistance level tracking unit mechanism 19. The mechanism has a knob 50 with ribs 53 that makes grasping the knob 50 easier. The top outer portion of the knob 50 has an outer label 20. The outer label 20 has indicia or other marking(s) 21 that indicate a pointer or similar indicator that points to indicia 31 on an inner label 30. The inner label 30 may further have markings 32 that indicate or describe the function of the knob. In this figure, the marking(s) 32 indicate "tension" in English. The knob 50 turns relative to the top housing 80.

The top housing 80 retains a shank 106 between the top housing 80 and the bottom housing 140 where a cable 101 protrudes and, in this example, terminates with an end cap 104. An additional cable (not shown) is connected to the end of the end cap and transfers motion, or pull of the cable 101 to the loading or braking system of exercise equipment such as, but not limited to a treadmill, a spinning bike, an upright bike, a recumbent bike, a stepper or an elliptical machine.

As the knob 50 is turned a cable is moved in and out of the shank. The rotational change is rotationally transferred to a potentiometer 160 located in the bottom housing 140. The potentiometer 160 is connected to a controller 170 that measures the resistance. The mechanical transfer of the rotation is better shown and described in other figures in this document.

Figure 2:
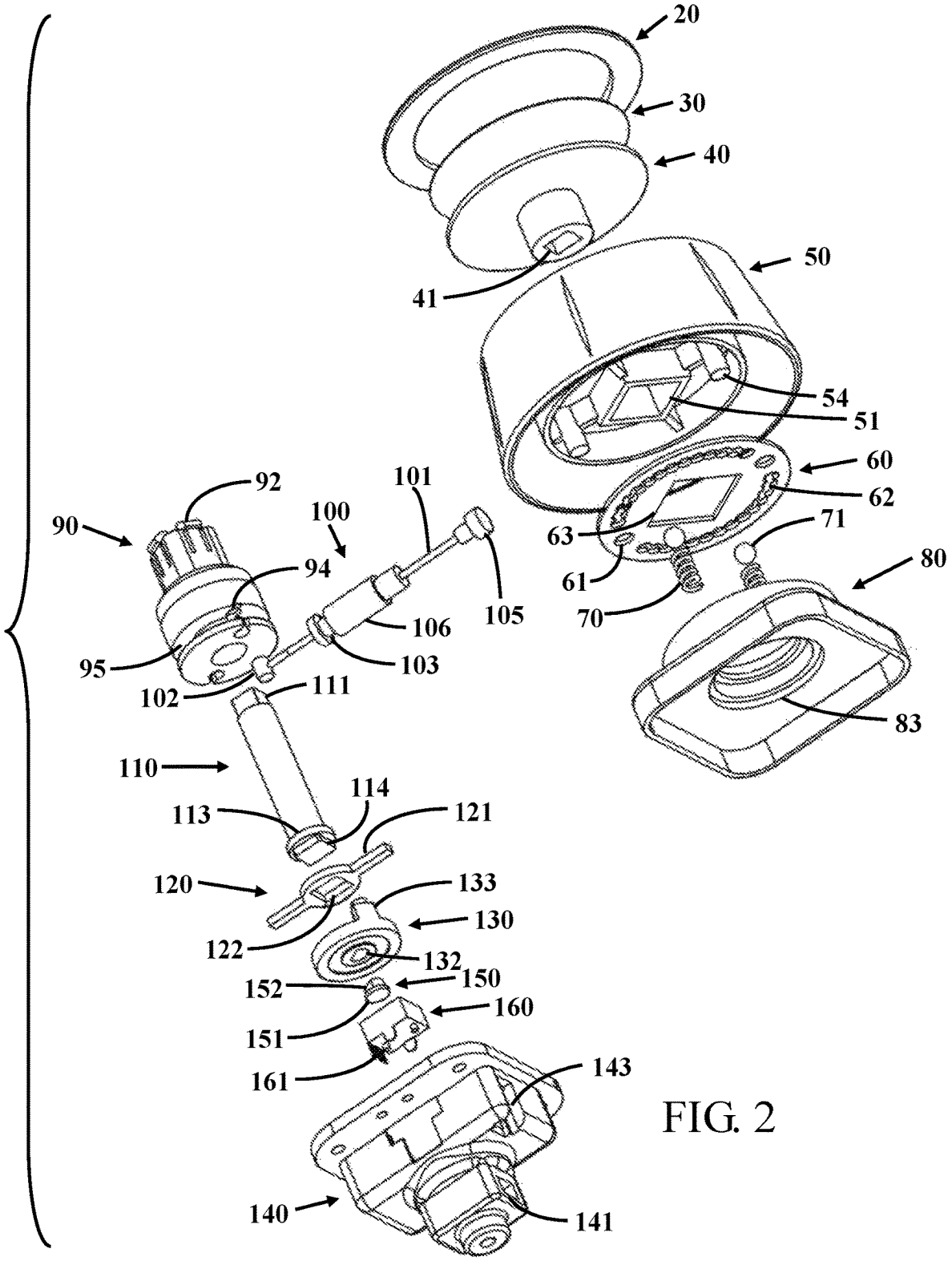
FIG. 2 shows an exploded view of the exercise machine resistance level tracking unit mechanism.
Figure 3:
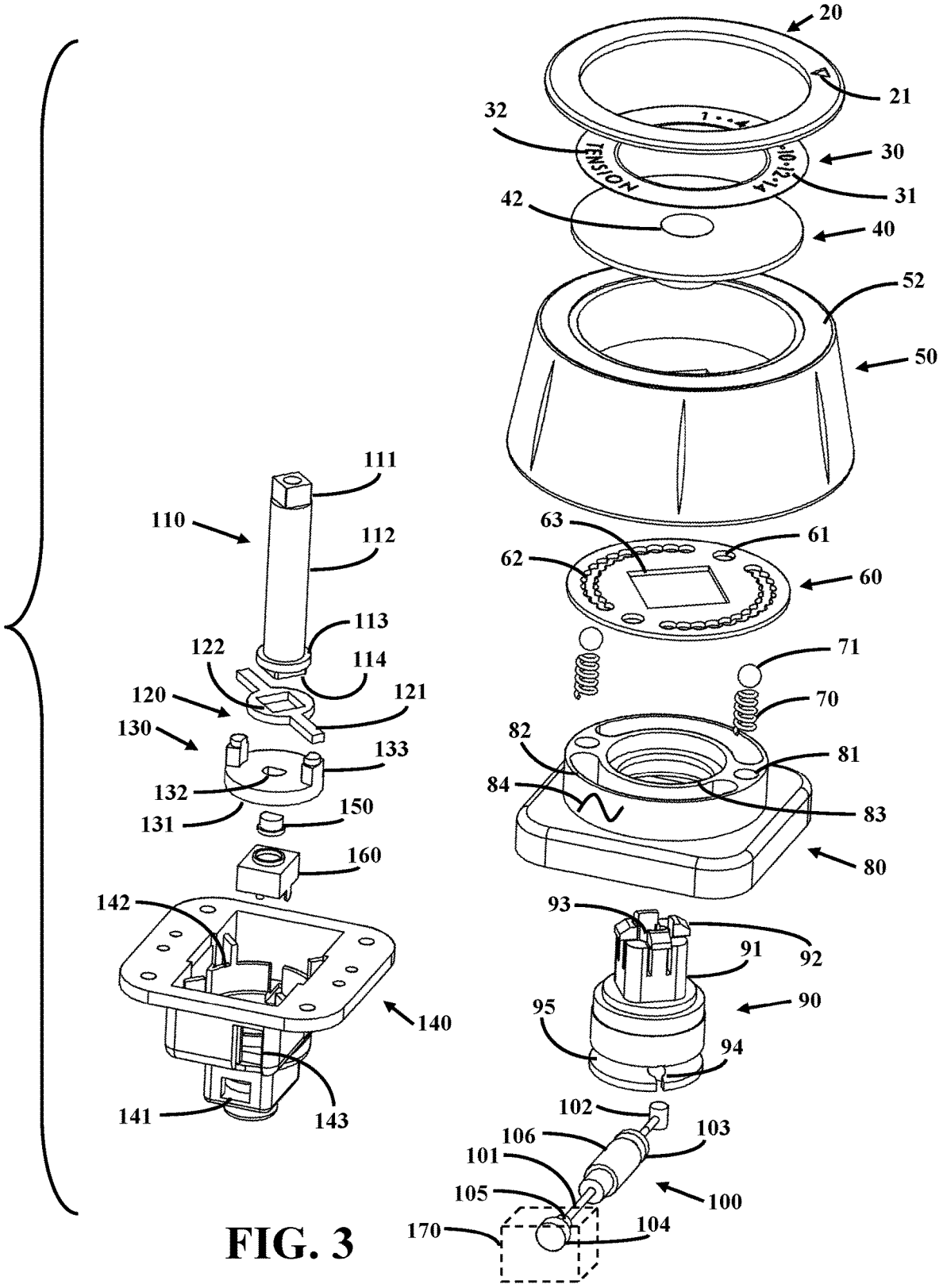
FIG. 3 shows an alternative exploded view of the exercise machine friction brake calibration mechanism.

FIG. 2 shows an exploded view of the exercise machine friction brake calibration mechanism and FIG. 3 shows an alternative exploded view of the exercise machine friction brake calibration mechanism. From these two figures the connection and interaction between the knob 50 and the cable 100 and the potentiometer 160/variable resistor will be shown and described. The knob 50 essentially provides a mechanism for a user to grasp and convert a desired change in resistance to the braking system 170 on the exercise equipment to the loading system that is typically with a brake on a flywheel. In this embodiment the knob 50 is a frustum cone with ribs or ridges that makes it easier for a user to grip, but the knob 50 can take a variety of shapes depending upon the structural and industrial design. The top of the knob 50 is covered with an outer label 20 having a marker 21 and indicating indicia 32. The outer label 20 is secured in the recess 52 of the knob 50.

An inner label 30 has markings or indicia 31 that indicates the different tension markings 32 or pull on the cable 100. These markings can also provide an indicator from the lowest to the highest settings or the extreme ends of travel of the cable 100. A disc cap 40 is connected to the inner label 30 and remains stationary. The hole 42 is typically covered with an additional label or can be covered with the inner label 30. The bottom of the disc cap 40 has a square recess 41 where the square head 111 of the post 110 connects through the knob 50. The knob 50 axially rotates around the post 110. The bottom of the knob 50 has a square hole 51 that fits on the square sides of the capstan 90. Snaps or hooks or spring lock tabs 92 fit through the square hole 51 in the knob 50 so rotation of the knob 50 also turns the capstan 90. The spring lock tabs 92 hold the capstan 90 onto the knob 50.

The bottom of the knob 50 also includes studs 54 that locate and engage into detent wheel 60. The detent wheel 60 has holes 61 for locating the detent wheel 60 on the studs 54 to maintain a fixed relationship of the detent wheel 60 on the knob 50. In one contemplated embodiment the detent wheel has a series of intersecting detent holes 62 or depressions where one or more spring 70 loaded balls 71 are pressed. The balls 71 ride into and out of the detent holes 62 to provide positive stops to the different positions indicated in the indicia 31 on the inner label as the indicia 31 markings align with the marker 21. The detent wheel has a square central opening or square hole 63 where the capstan 90 passes through the detent wheel and turns with the knob 50 and the capstan 90.

The springs 70 fit into spring clearance hole openings 81 in the top housing 80. A raised rim side wall 84 provides support for the springs 70. The center of the top housing 80 has a center hole 83 where the capstan 90 and the post 110 can fit through and operates as a bearing for the round sides of the capstan 90.

The capstan 90 has a round lower portion that turns in the round opening 83 of the upper housing and a square portion with vertical walls 91 that engage through the square hole 63 in the detent plate 60 and through the square hole 51 in the knob 50. The round lower portion has a round slot or circular hole 94 where the pivot end 102 of the cable leader 100 locates. As the knob 50 is rotated, it will turn the capstan 90 and the pivot end to the cable leader 100 will be drawn around the capstan 90 and the cable 101 will fit within the circular recess 95. A central opening 93 in the capstan 90 provides clearance for the shank 112 of the post 110 to pass and allows for rotation of the knob 50 to be transferred through the post 110.

The bottom of the post 110 has a flat shoulder 113 and a square drive 114. The square drive 114 fits into a square hole 122 in the drive stop 120. The drive stop 120 has one or more arms 121 that limit rotational turning of the knob 50 when the arms 121 contact tabs 133 that extend from the wheel 130. The rotation of the wheel is transferred through a cap 150 to a potentiometer 160, variable resistor or another sensor type. The cap 150 has a flat 152 that engages in the sector hole 132 in the wheel 130. The cap bottom 151 of the cap 150 is configured with a drive that engages into the top of the potentiometer 160. The potentiometer 160, is secured in the bottom of the bottom housing 140, and the bottom housing 140 has sides that engage on the sides of the top housing 80 to prevent rotation. The center of the bottom housing has a circular set of ribs central portion 142 that also provides bearing surfaces for the capstan 90. An opening 141 in the bottom housing 140 provides clearance for electrical contacts 161 on the potentiometer 160.

The cable leader 100 has a circular recess 103 in the shank 106. The circular recess 103 fits into, engages and is retained in the fingers 143 and is captured in the fingers 143 that grasp the sides of the recess 103. This retention prevents movement of the shank 106 and allows the cable 101 to move in the shank as the knob 50 is rotated to allow the cable to slide on the shank. The end of the cable leader has an end cap 104 where the shoulder 105 is retained in a clasp that transfers the tension and movement of the cable leader 100 to the braking system in the exercise equipment.

Figure 4:
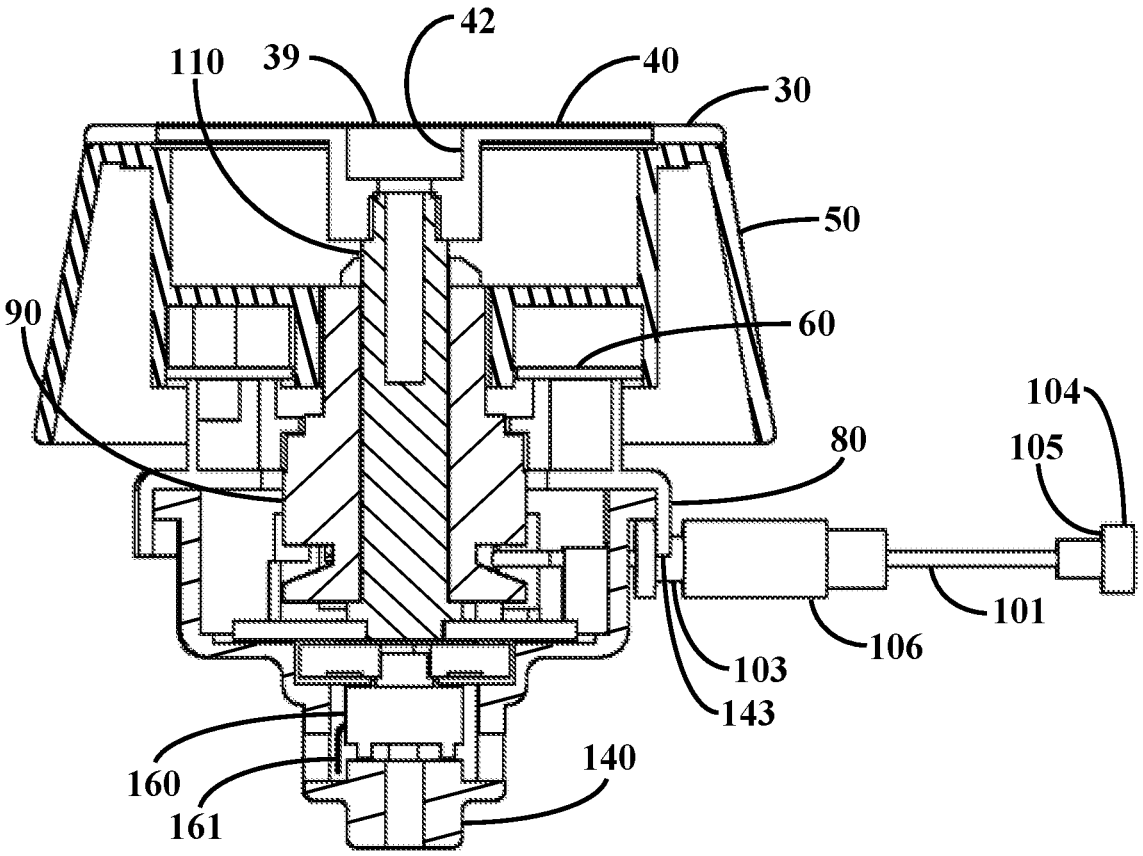
FIG. 4 shows a cross-sectional view of the exercise machine friction brake calibration mechanism.

FIG. 4 shows a cross-sectional view of the exercise machine friction brake calibration mechanism. This cross-section shows the knob 50 with an inner label 30, a disc cap 40 with a recess 42. A cover 39 covers the internal mechanism. The post 110 is shown connecting to the knob 50. The post 110 is shown passing through the capstan 90 and the detent wheel 60.

The shank 106 where the cable 101 passes is shown with the recess 103 captured in the finger 143 of the top housing 80. The opposing end of the cable 101 has an end cap 104 with a shoulder 105 where the cable 101 connects to the loading system of exercise equipment. The lower portion of the bottom housing 140 shows the potentiometer 160 with the electrical contacts 161.

Figure 5:
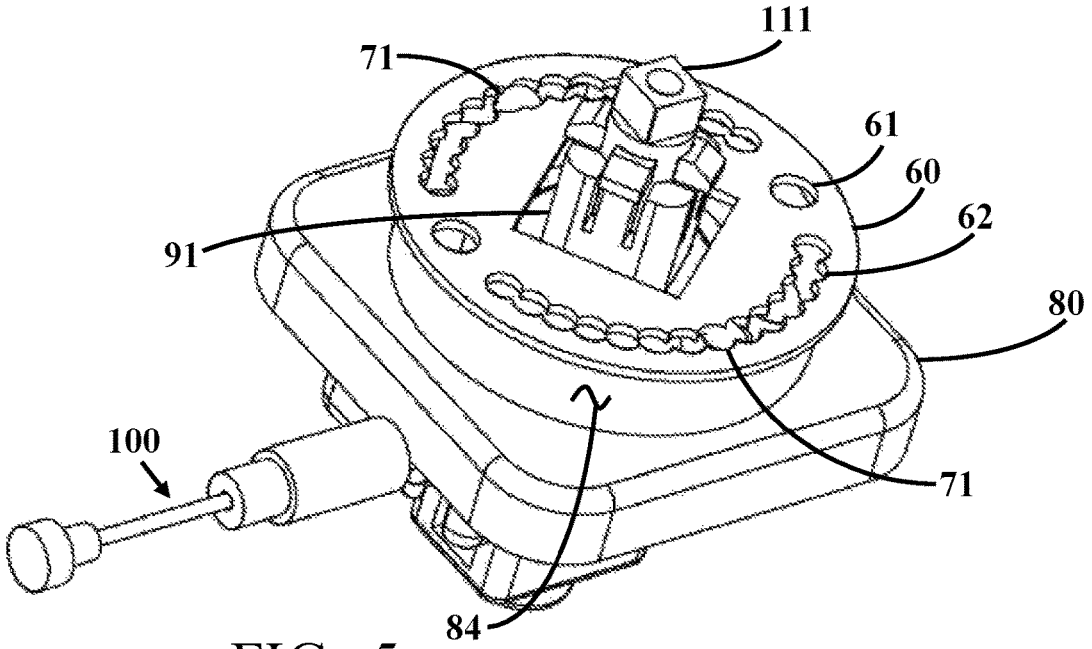
FIG. 5 shows a perspective partial assembled view.
Figure 6:
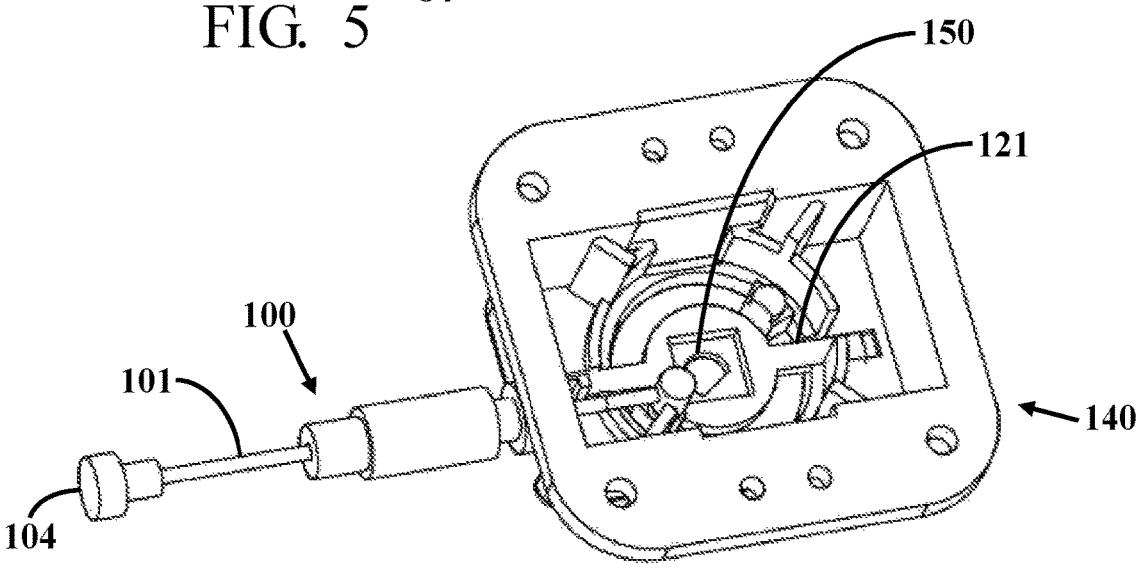
FIG. 6 shows a perspective partial assembled view.
Figure 7:
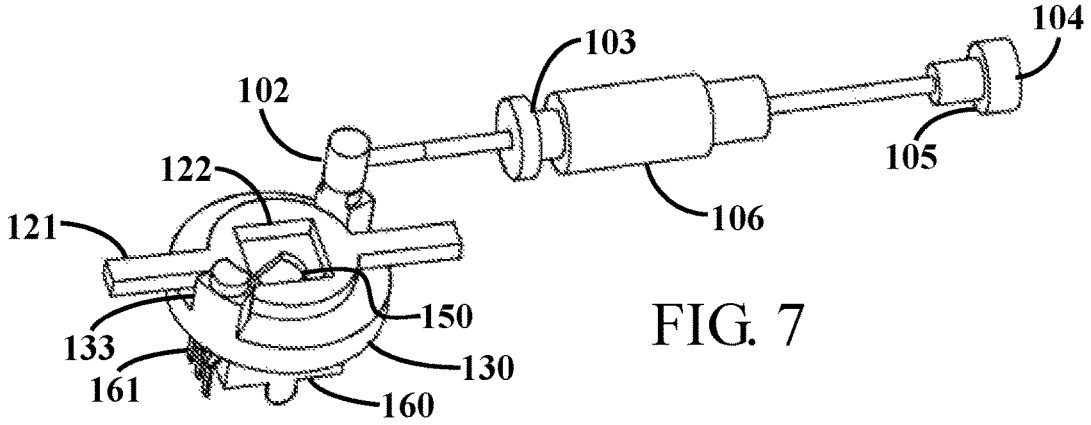
FIG. 7 shows a perspective partial assembled view.

FIGS. 5-7 show perspective partial assembled views. The upper portion of the knob has been removed, and the progressive figures remove additional components. In FIG. 5 the detent wheel 60 is shown with the locating hole 61, the intersecting detent holes 62. Balls 71 are visible engaged in some of the detent holes 62. The detent wheel 60 shows the square head 111 of the post passing through the vertical walls 91 of the capstan. The detent wheel is shown above the side walls 84 of the top housing 80. The end of the cable leader 100 is shown extending out of the sub assembly.

In FIG. 6 additional components have been removed. In this view, the link from the end cap 104 to the cable 101 of the cable leader 100 is shown entering the bottom housing 140. The cap 150 on the potentiometer is shown with the arms 121 that limit rotation of the potentiometer.

FIG. 7 shows the connection from the potentiometer 160 to the end cap 104. The potentiometer 160 has contacts 161 or terminals that allow electrical contact to the display.

The cap 150 interfaces the potentiometer with the sector hole 32 on the wheel 130. The tab 133 interfaces with the capstan 95 that transfers the rotation of the knob 50 to the potentiometer 160. The arms 121 are recessed and tabs 133 of the wheel 130 limit rotation of the mechanism. The pivot end 102 moves with the potentiometer 160 to move the cable 101 through the shank 106. The recess 103 holds the shank 106 at a fixed location as the cable 101 moves. The shoulder 105 of the end cap 104 pulls a connector that places tension on a braking system.

Calibration of the exercise machine friction brake calibration mechanism is performed by setting the knob 50 at specific numbers indicated on the indicia on the inner label 30 and measuring the resistance at the terminals 161 of the potentiometer 160.

A tension meter can be placed on the cable or a dynamometer can be used to drive the flywheel and the load on the dynamometer can be set to the measured resistance value of potentiometer 160 to accurately determine work energy or calories being burned at each setting and rotational speed of the flywheel as a function of setting of the knob 50 or on a display.

Thus, specific embodiments of an exercise machine friction brake calibration mechanism have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. An exercise machine resistance brake calibration mechanism comprising:

a rotatable knob on a housing;

said rotatable knob being connected to a capstan through a shaft;

said capstan is secured to a first end of a cable, and said cable passes through a shank near said first end of said cable that is secured to said housing;

said cable terminates at an end cap at a second end of said cable that is connected to a braking system on said exercise machine wherein;

rotation of said rotatable knob wraps said cable on said capstan and alters a tension on said first end of said cable that in-turn alters said braking system that is connected to said end cap of said cable, and a potentiometer connected to said shaft, whereby a position of said rotatable knob is measured as a resistance of said potentiometer that corresponds to an exercise resistance on said exercise machine.

2. The exercise machine resistance brake calibration mechanism according to claim 1, wherein said potentiometer is measured by a controller.

3. The exercise machine resistance brake calibration mechanism according to claim 2, wherein said controller is on a fitness equipment.

4. The exercise machine resistance brake calibration mechanism according to claim 3, wherein said fitness equipment is selected from a group consisting of a treadmill, a spinning bike, an upright bike, a recumbent bike, a stepper, an under desk equipment, an under desk bikes, an under desk elliptical or an upright elliptical machine.

5. The exercise machine resistance brake calibration mechanism according to claim 1, wherein said braking system is on a fitness equipment.

6. The exercise machine resistance brake calibration mechanism according to claim 5, wherein said braking system is a friction brake that creates a load on a flywheel.

7. The exercise machine resistance brake calibration mechanism according to claim 1, wherein a resistance from said potentiometer is calibrated to a load on said braking system.

8. The exercise machine resistance brake calibration mechanism according to claim 7, wherein said calibrated to a load is determined from at least two different resistance readings with at least two different loads.

9. The exercise machine resistance brake calibration mechanism according to claim 7, wherein said calibrated to a load is determined from at least two different rotation speeds of a flywheel.

10. The exercise machine resistance brake calibration mechanism according to claim 1, wherein said rotatable knob includes a drive stop that limits rotation of said rotatable knob in at least one direction of rotation.

11. The exercise machine resistance brake calibration mechanism according to claim 10, wherein said drive stop limits rotational turning of said rotatable knob.

12. The exercise machine resistance brake calibration mechanism according to claim 10, wherein said drive stop has at least one arm that rotates with said rotatable knob.

13. The exercise machine resistance brake calibration mechanism according to claim 1, wherein said rotatable knob is connected to a detent wheel having a plurality of through holes.

14. The exercise machine resistance brake calibration mechanism according to claim 1, wherein said rotatable knob has indicia that indicates at least two positions that indicates a rotated position of said rotatable knob, said potentiometer and said exercise resistance on said exercise machine.

15. The exercise machine resistance brake calibration mechanism according to claim 1, wherein said potentiometer is a single turn potentiometer.

16. The exercise machine resistance brake calibration mechanism according to claim 1, wherein holes or depressions in a detent wheel that are indexed by a spring-loaded ball.

17. The exercise machine resistance brake calibration mechanism according to claim 1, wherein rotation of said rotatable knob turns said capstan that pulls said first end of said cable around a circular recess.

18. The exercise machine resistance brake calibration mechanism according to claim 1, wherein said rotatable knob includes indicia that relates to tension on said cable.

* * * * *